United States Patent [19]

Tarmann

[11] 4,239,078

[45] Dec. 16, 1980

[54] COOLED CONTINUOUS CASTING MOULD

[75] Inventor: Bruno Tarmann, Kapfenberg, Austria

[73] Assignee: Voest-Alpine Aktiengesellschaft, Linz, Austria

[21] Appl. No.: 22,517

[22] Filed: Mar. 21, 1979

[30] Foreign Application Priority Data

Mar. 23, 1978 [AT] Austria ..... 2073/78

[51] Int. Cl.[3] ..... B22D 27/02; B22D 11/10

[52] U.S. Cl. ..... 164/147; 164/49; 164/418; 164/443

[58] Field of Search ..... 164/49, 147, 250, 251, 164/418, 443

[56] References Cited

U.S. PATENT DOCUMENTS

| | | | |
|---|---|---|---|
| 2,944,309 | 7/1960 | Schaaber | 164/147 |
| 3,455,372 | 7/1969 | Yamamoto | 164/251 X |
| 3,525,380 | 8/1970 | Moore | 164/250 X |
| 3,735,799 | 5/1973 | Karlson | 164/147 |
| 4,026,346 | 5/1977 | Birat et al. | 164/147 |
| 4,139,047 | 2/1979 | Parrish | 164/443 X |

FOREIGN PATENT DOCUMENTS

| | | |
|---|---|---|
| 185518 | 5/1956 | Austria . |
| 196077 | 2/1958 | Austria . |
| 200269 | 10/1958 | Austria . |
| 900861 | 1/1954 | Fed. Rep. of Germany . |
| 1050029 | 8/1959 | Fed. Rep. of Germany . |
| 1939653 | 2/1971 | Fed. Rep. of Germany . |
| 2448275 | 9/1974 | Fed. Rep. of Germany . |
| 2553087 | 12/1975 | Fed. Rep. of Germany . |
| 2628293 | 1/1977 | Fed. Rep. of Germany . |
| 738622 | 8/1952 | United Kingdom . |
| 793356 | 4/1958 | United Kingdom . |

*Primary Examiner*—Gil Weidenfeld
*Assistant Examiner*—Gus T. Hampilos
*Attorney, Agent, or Firm*—Brumbaugh, Graves, Donohue & Raymond

[57] ABSTRACT

A cooled continuous casting mould has an arrangement for producing a rotating electromagnetic field of force in the unsolidified region of the melt cast in the mould. The mould is designed as a compound body formed of an upper wall of copper or a low-alloyed copper alloy, and a lower wall of an antimagnetic material with low electrical conductivity. The two walls delimit the mould inner space, and the lower wall is surrounded by an induction arrangement for producing the rotating electromagnetic field.

9 Claims, 5 Drawing Figures

COOLED CONTINUOUS CASTING MOULD

BACKGROUND OF THE INVENTION

The invention relates to a cooled continuous casting mould comprising an arrangement for producing a rotating electromagnetic field of force in the unsolidified region of the melt.

It has long been known that it is possible to influence solidification during continuous casting of high-melting metals, by applying rotating electromagnetic fields of force, thus achieving metallurgical and technological advantages, in particular a more uniform grain structure of the cast product. Suitably, the application of the rotating field is effected in the region of the casting level.

The mould material best suited for a rapid formation of a load-bearing skin is copper, to which, for the achievement of improved strength, alloy elements, such as chromium, silver, beryllium, zircon and the like can be added in small amounts. These mould materials, however, strongly shield the force of an applied elecromagnetic field, so that the movement of the liquid melt by the influence of the field does not appear to the desired extent, particularly if the field of force is operated at power line frequency. It is therefore not practical to apply an induction yoke in the region of the mould in which the wall delimiting the inner cavity of the mould is comprised of copper. If, however, a material is used which has a lower electric conductivity than copper and thus a higher permeability to magnetic fields of force, such as brass, aluminium, molybdenum, chromium-nickel-steel and the like, only a short useful life of the mould can be reached, which is not sufficient for production plants.

For avoiding these difficulties it has already been proposed to operate the induction arrangement with a lower frequency, e.g. 1 to 10 Hz, instead of operating it at power line frequency, i.e. 50 to 60 Hz, whereby the losses during the penetration of the copper wall by the field of force will be reduced. Because of this, however, the arrangement will become more complex, since additional frequency transformers are required.

For avoiding the described difficulties it has also been proposed to provide the induction arrangement, not in the region of the continuous mould, but at a smaller or larger distance below the mould. With this arrangement the advantages of influencing the solidification near the casting level and thus producing an advantageous formation of the skin structure, are loss. In particular a more rapid initial solidification, a more finely grained rim structure, a reduced trans-crystalline zone, a lesser sensitivity to tensional cracks, and thus avoidance of surface cracks and internal cracks near the surface, have to be given up. Also a segregation streak will form at the solidification border in the region of the rotating field, which streak reduces the quality of the cast product.

These disadvantages appear all the more, because mould lengths in a range of 600 to 850 mm are typically used for reasons of operational safely, especially with high casting speeds, although a mould length of only 100 to 200 mm is sufficient for the formation of a skin.

SUMMARY OF THE INVENTION

The invention aims at avoiding the described disadvantages and difficulties when using moulds that include an induction arrangement for the production of an electromagnetic field of force. The invention has as its object to provide a mould of this kind which, with an improved service life, makes possible an improved influence on the solidification of the molten metal near the mould level, and which is suited for production plants.

According to the invention the mould is designed as a compound body and comprises upper and lower walls delimiting the mould inner space. The upper wall is made of copper or a low-alloyed copper alloy, and the lower wall is made of an antimagnetic material with low electrical conductivity. The lower wall is surrounded by an induction arrangement for producing electromagnetic rotating field.

It is true that compound moulds are known per se with which both the upper and the lower parts delimiting the mould cavity are made of copper. Such a compound or double mould was proposed in order to increase its service life by exchanging only the upper part of the mould whenever it becomes warped. That mould has, however, not proved successful in operation, since the expected cost advantages could not be realized because of the difficulties involved in maintaining a tight seal between its parts, etc.

Compared to this, sealing-off difficulties or a slight increase in the expenditure for the cooling of the compound mould according to the invention are not important, since the desired influence on the skin growth and the grain structure can be achieved in a considerably more effective and safer way than hitherto has been the case.

According to a preferred embodiment of the invention, the lower wall delimiting the mould inner space is made of brass, multi-material aluminium-bronze, aluminium, anti-magnetic steel, such as chromium-nickel-austenite-steel, nickel-steel or manganese-high-carbon-steel. When using highly wear-resistant steel, such as chromium-nickel-austenite-steel or 12% maganese-high-carbon-steel, an additional advantage is obtained in that the mould will become resistant to wear in its lower part. In this lower part, as is known, high frictional forces frequently occur which, when using a relatively soft mould material, cause rapid wear.

Advantageously, the upper and the lower parts of the mould possess a common cooling system.

Suitably, the upper and the lower parts of the mould each comprise a separate cooling-water box.

A further preferred embodiment of the continuous casting mould according to the invention is characterized in that the walls delimiting the upper mould cavity and the lower mould cavity are centered by an annular ledge and are sealed off by a soft seal.

Advantageously, both the wall delimiting the upper mould inner space and that delimiting the lower mould inner space include a hard-chromium plating cover in order to form a jointless inner face.

For the purpose of effecting a simple change of section, the walls delimiting the upper mould cavity and those limiting the lower mould cavity, together with an intermediate cooling jacket surrounding them, constitute a construction unit that can be installed into, and removed from, a common cooling box, whereby the electrical equipment need not be exchanged with a change of section.

As mentioned before, a mould length of 100 to 200 mm will suffice for the initial solidification, i.e. for the formation of a strong skin. Since the casting level usually lies about 100 mm below the mould upper rim, the length of the copper part needs to be only 200 to 300 mm at least. Since the field of rotation applied is to be as near as possible to the mould level, in order to fully make use of the advantages of the influence on the grain structure, the length of the copper part, according to the invention, will be 450 mm at most. Advantageously, the mould length will be of copper for one half and of the material with the lower electrical conductivity for the other half.

BRIEF DESCRIPTION OF THE DRAWINGS

The invention will now be explained in more detail by way of three exemplary embodiments and with reference to the accompanying drawings, wherein.

DESCRIPTION OF EXEMPLARLY EMBODIMENTS

Figure 1:
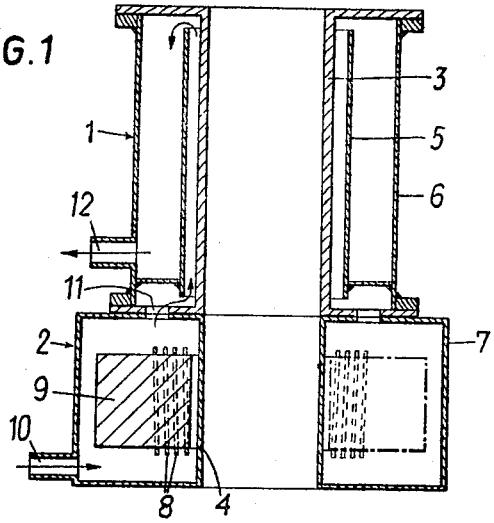
FIGS. 1 and 2 each illustrate a vertical section through a continuous casting mould for the production of a billet with a round cross section.
Figure 2:
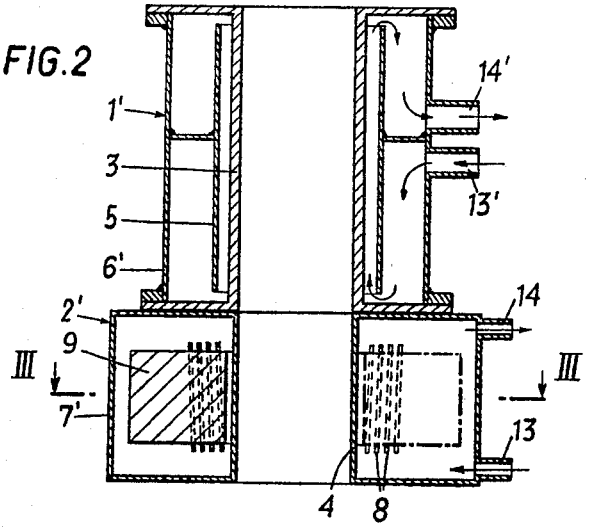
Figure 3:
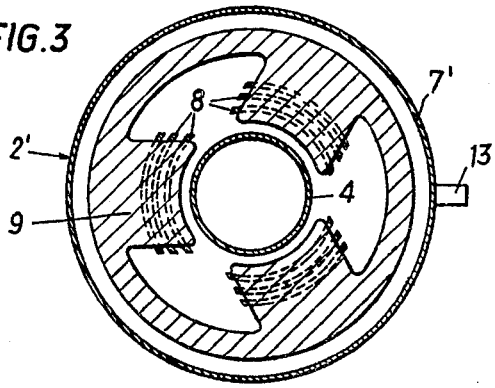
FIG. 3 is a cross section according to line III—III, through the lower art of one of FIGS. 1 or 2.

In FIG. 1 a mould comprises an upper part 1 and a lower part 2 with the wall 3 delimiting the upper mould inner space made up of copper and the wall 4 delimiting the lower mould inner space made up of austenitic chromium-nickel-steel. The upper wall 3 made of copper is surrounded by an inner jacket 5 and a cooling box 6. The lower wall 4 is surrounded by a cooling box 7 in which an induction yoke 9 comprised of windings 8 is contained. The cooling water enters at inlet 10 into the lower cooling box 7. The cooling water reaches the upper cooling box 6 via a cooling-water penetration opening 11 and flows off through an outlet 12. With the modified embodiment according to FIG. 2, the upper and the lower parts 1', 2' of the mould comprise cooling boxes 6' and 7' that are totally separated from each other. They have their own supply and drain conduits 13, 14, 13', 14' for the cooling water.

Figure 4:
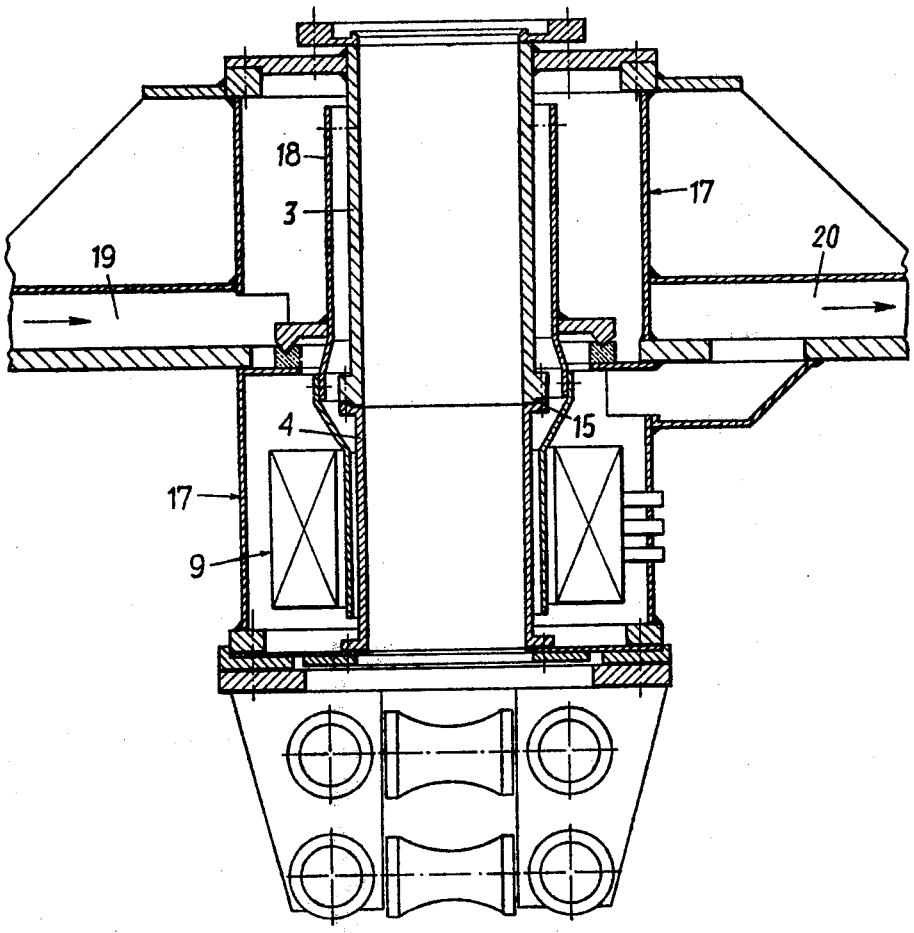
FIG. 4 shows a vertical section through a further preferred embodiment of a continuous casting mould.
Figure 5:
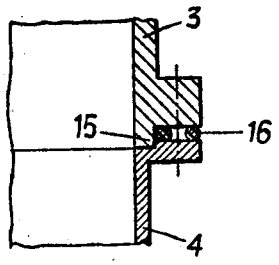
FIG. 5 is a detail of FIG. 4.

With the embodiment according to FIG. 4 the inner wall 3 delimiting the upper mould inner space is again made of copper, and the wall 4 delimiting the lower mould inner space is made of austenitic chromium-nickel-steel or manganese high-carbon steel. The walls 3 and 4 are centered on each other by an annular ledge 15 and are sealed off towards the outside of the mould by soft seal, such as O-ring-seals 16. The inner faces of the walls 3 and 4 that abut each other without gaps. Suitably, the total inner face is covered with a hard-chromium plating layer so that there is no joint on the inner face.

The mould possesses a cooling box 17 that extends over the total length of the mould, a cooling water circuit being formed by the intermediate jacket 18 which is fastened to the inner walls 3 and 4, respectively, by consoles. The water supply is effected through conduit 19 and the water removal is through conduit 20. In the lower part of the cooling box, the induction yoke 9 for the production of the rotating electromagnetic field is arranged. The advantage of this embodiment is that the total inner part can be assembled in workshops and the upper and the lower inner walls can be ground and hard-chromium plated together, so that the fit is perfect. The whole inner part including the intermediate jacket 18 is easily exchangeable, so that also a change of section is possible without exchanging the electric equipment. The cooling box and the mould casing advantageously are made of 18/8 chromium-nickel steel.

What I claim is:

1. In a cooled continuous casting mould for a melt having an unsolidified region, said mould being of the type including a means for producing a rotating electromagnetic field of force in said unsolidified region of said melt, the improvement which is characterized in that said cooled continuous casting mould has an inner mould cavity and is designed as a compound body formed of an upper wall and a lower wall, said upper wall and said lower wall delimiting said inner mould cavity for contacting and shaping the melt during casting, said upper wall being made of a material selected from the group consisting of copper and low-alloyed copper alloys, said lower wall being made of an antimagnetic material with low electrical conductivity, said means for producing a rotating electromagnetic field of force being an induction means surrounding said lower wall.

2. A cooled continuous casting mould as set forth in claim 1, wherein said lower wall is made of a material selected from the group consisting of brass, multimaterial aluminium-bronze, aluminium and antimagnetic steel.

3. A cooled continuous casting mould as set forth in claim 2, wherein said antimagnetic steel is selected from the group consisting of chromium-nickel-austenite-steel, nickel steel and manganese-high-carbon-steel.

4. A cooled continuous casting mould as set forth in claim 1, wherein said cooled continuous casting mould has an upper part and a lower part, a common cooling system being provided for said upper part and said lower part.

5. A cooled continuous casting mould as set forth in claim 1, wherein said cooled continuous casting mould has an upper part and a lower part, a separate cooling-water box being provided for each of said upper part and said lower part.

6. A cooled continuous casting mould as set forth in claim 1, further comprising an annular ledge for centering said upper wall and said lower wall, and a soft seal for sealing off said upper wall relative to said lower wall.

7. A cooled continuous casting mould as set forth in claim 6, further comprising a hard-chromium plating layer provided on said upper wall and said lower wall so as to form an inner face without joints.

8. A cooled continuous casting mould as set forth in claim 1, further comprising an annular ledge for centering said upper wall and said lower wall, a soft seal for sealing off said upper wall relative to said lower wall, an intermediate jacket surrounding said upper wall and said lower wall, and a common cooling box provided for both said upper wall and said lower wall, said upper wall and said lower wall together with said intermediate jacket forming a construction unit, said construction unit being installable into, and removable from, said common cooling box.

9. A cooled continuous casting mould as set forth in claim 7, further comprising an intermediate jacket surrounding said upper wall and said lower wall, and a common cooling box provided for both said upper wall and said lower wall, said upper wall and said lower wall together with said intermediate jacket forming a construction unit, said construction unit being installable into, and removable from said common cooling box.

* * * * *

UNITED STATES PATENT AND TRADEMARK OFFICE

CERTIFICATE OF CORRECTION

PATENT NO. : 4,239,078

DATED : Dec. 16, 1980

INVENTOR(S) : Bruno Tarmann

It is certified that error appears in the above—identified patent and that said Letters Patent is hereby corrected as shown below:

Col. 1, line 22, "elecro-" should read --electro-; line 41, after "this" insert --procedure--; line 50, "loss" should read --lost--. Col. 2, line 12, after "producing" insert --an--; line 59, "limiting" should read --delimiting--. Col. 3, line 19, "art" should read --part--; line 24, "EXEMPLARLY" should read --EXEMPLARY--; line 50, "seal" should read --seals--; line 51, delete "that".

Signed and Sealed this

*Tenth* Day of *March 1981*

[SEAL]

*Attest:*

RENE D. TEGTMEYER

*Attesting Officer*

*Acting Commissioner of Patents and Trademarks*